US006020807A

United States Patent [19]

Givler

[11] Patent Number: 6,020,807

[45] Date of Patent: Feb. 1, 2000

[54] SEALED CASE HOLD OPEN THERMOSTAT

[75] Inventor: Omar R. Givler, North Canton, Ohio

[73] Assignee: Portage Electric Products, Inc., North Canton, Ohio

[21] Appl. No.: 09/256,281

[22] Filed: Feb. 23, 1999

[51] Int. Cl.[7] ..... H01H 37/14; H01H 61/02; H01H 37/52; H01H 37/04

[52] U.S. Cl. ..... 337/377; 377/77; 377/100; 377/101; 377/102; 377/107; 377/141; 377/333; 377/362; 377/398; 377/324

[58] Field of Search ..... 337/377, 380, 337/381, 324, 77, 100, 102, 103, 104, 107, 333, 362, 365, 417, 16, 27, 34, 36, 85, 101, 112, 121, 141, 398

[56] References Cited

U.S. PATENT DOCUMENTS

| | | | |
|---|---|---|---|
| 3,525,914 | 8/1970 | Vind | 318/792 |
| 3,622,930 | 11/1971 | D'Entremont | 337/107 |
| 3,840,834 | 10/1974 | Obenhaus et al. | 337/79 |
| 4,015,229 | 3/1977 | Senor et al. | 337/107 |
| 4,086,558 | 4/1978 | Pejouhy et al. | 337/102 |
| 4,136,323 | 1/1979 | D'Entremont et al. | 337/107 |
| 4,220,938 | 9/1980 | Grable | 337/89 |
| 4,236,135 | 11/1980 | Holden | 337/89 |
| 4,399,423 | 8/1983 | Nield | 337/102 |
| 4,458,231 | 7/1984 | Senor | 337/107 |
| 4,476,452 | 10/1984 | D'Entremont | 337/102 |
| 4,878,038 | 10/1989 | Tsai | 337/107 |
| 5,607,610 | 3/1997 | Furukawa | 219/505 |
| 5,936,510 | 8/1999 | Wehl et al. | 337/377 |

FOREIGN PATENT DOCUMENTS

| | | | |
|---|---|---|---|
| 3128090A1 | 4/1982 | Germany | H01H 61/02 |
| 409326225A | 12/1997 | Japan | H01H 37/54 |

*Primary Examiner*—Gerald Tolin
*Assistant Examiner*—Anatoly Vortman
*Attorney, Agent, or Firm*—Darby & Darby

[57] ABSTRACT

A thermostat includes a case, including an exterior, that is made of conductive material. A cover plate is made of a conductive material. The cover plate is connected to the case to define a sealed interior. The cover plate has a contact projecting into the sealed interior. The contact is fixed with respect to the case and has an interior contact position. An insulator sheet is disposed between the case and the cover plate. A blade is disposed in the sealed interior. A second end of the blade moves between a first position where it abuts the contact position of the contact and a second position where it is spaced from the interior contact position of the contact. A resistor is mounted on a first end of the blade. The resistor is disposed between the cover plate and the blade in the sealed interior of the case. The resistor has a first side facing and abutting the cover plate, and a second side facing and abutting the blade so that the resistor is electrically connected between the cover plate and the blade. The resistor has a sufficient resistance so that when the second end of the blade moves from the first position to the second position a sufficient amount of heat is generated by the current flowing through the resistor to maintain the second end of the blade in the second position until a load current applied to the cover plate and the blade is removed.

12 Claims, 2 Drawing Sheets

SEALED CASE HOLD OPEN THERMOSTAT

BACKGROUND OF THE INVENTION

1. Field of the Invention

This invention relates generally to bimetal thermostats for use in electric circuits. More specifically, the invention relates to a sealed case thermostat, where, after the thermostat snaps to the open position, the thermostat remains in the open position until the power supplied to the device is turned off or removed.

2. Discussion of the Related Art

Thermostats use a bimetal blade, which is essentially two strips of metal having different coefficients of expansion laminated to each other. With an increase in ambient temperature, the blade will bend away from the side containing the material with the higher coefficient of expansion. In the case of a so-called snap action blade, the blade is molded with a formed midsection so that the bending in response to increased temperature will not be gradual, but will occur suddenly once a threshold temperature is achieved. Thus, the blade will "snap" to its bent position.

For a commercial thermostat, these bimetal blades are incorporated into a case and/or placed adjacent to another contact so that an electrical connection will be either formed or broken as the bimetal blade bends. This type of thermostat has many applications, but has recently been used extensively in the electronics industry, mainly because of the ability to make these thermostats relatively compact.

Recently, new standards have been instituted for some motors, transformers, home appliances, etc., where if the device overheats, the thermostat that is mounted within the device, upon reaching the overheated condition, is now required to snap to the open or off position and thereafter remain in the open position until the power supply is, in some fashion, removed from the device.

U.S. Pat. No. 4,703,298 to Gerson discloses a thermostat that includes ceramic mounting pins 4, 5 that are made of ceramic PTC material. The thermostat is a non-enclosed device and is, therefore, subject to atmospheric conditions. Two metal contact carriers 2, 3 are fastened onto parallel pins 4, 5. Carriers 2 and 3 are selectively moveable relative to each other on pins 4 and 5, so that the thermostat can be adjusted for a specific circuit opening temperature. The thermostat is required to be non-enclosed to permit the carriers 2, 3 to move with respect to the pins 4, 5.

In use, when the bimetal 7 moves to the open position, the temperature is such that the resistance of the PTC material is substantial, so that the current which now flows through the pins generates sufficient heat to keep open the circuit between carriers 2, 3. This current flow, together with the selective resistivity of the pins at this temperature, is sufficient to maintain the bimetal 7 above its reset temperature even though the ambient temperature being monitored by the thermostat may return to its original or normal level. The thermostat thus remains open until it is allowed to reset because it has been disconnected from the circuit, whereby the heat source is removed and the bimetal 7 is permitted to snap to the closed contact position because it is at a temperature below the reset temperature.

U.S. Pat. No. 3,525,914 to Vind discloses a thermo switch that includes a ceramic PTC heat resistor 14 that is mounted between the inner surfaces 19, 20 of the bimetallic strips. Similarly, U.S. Pat. No. 5,309,131 to Hofsäss discloses utilizing a PTC resistor 2 mounted between a fixed contact 6 and a moveable contact 7. In all these disclosures, current flows through the PTC resistor regardless of whether the switch is open or closed. The resistance of the PTC resistor increases with increasing ambient temperature. Vind's, Hofs äss' and Gerson's switches open when the ambient temperature is above the reset temperature. The PTC resistor in each is designed to generate a sufficient amount of heat so that the temperature is above the reset temperature to maintain the switch open. Thus, the switch of either Vind, Hofsäss or Gerson remains open until the load current is removed.

A PTC resistor is designed to have a relatively low resistance when the ambient temperature is below a threshold value. Thus, when the switch is closed, current flows through the PTC resistor, but because the resistance is relatively low, an insufficient amount of heat is generated to increase the temperature at the thermostat above the actuation level. Only when the ambient temperature rises above a predetermined point is the resistance of the PTC sufficient to generate significant heat.

For many uses it is desirable for the thermostat to be enclosed, sealed from the local ambient conditions to ensure the efficient operation of the thermostat. Sealed thermostats can be calibrated or adjusted for a specific circuit opening temperature by distorting the case at a predetermined location as is well known in the art (see, for example, U.S. Pat. Nos. 3,443,259 and 3,223,808, the disclosures of which are hereby incorporated by reference).

Thus, it is an object of the present invention to provide a sealed case hold open thermostat. It is a further object of the present invention to provide a sealed case hold open thermostat that uses a conventional resistor (i.e., the present invention thermostat does not utilize a PTC resistor). In the present invention, significant current only flows through the resistor when the switch is in the open position. Additionally, the amount of heat generated by the resistor is not dependent upon the ambient temperature. There is a need in the art for such a hold open thermostat in which a conventional resistor is electrically connected between a bimetallic blade and a fixed blade or a live case.

SUMMARY OF THE INVENTION

In accordance with a currently preferred embodiment of the present invention, a thermostat includes a case, including an exterior, that is made of conductive material. A cover plate is made of a conductive material. The cover plate is connected to the case to define a sealed interior. The cover plate has a contact projecting into the sealed interior. The contact is fixed with respect to the case and has an interior contact position. An insulator sheet is disposed between the case and the cover plate. A blade is disposed in the sealed interior. A second end of the blade moves between a first position where it abuts the contact position of the contact and a second position where it is spaced from the interior contact position of the contact. A resistor is mounted on a first end of the blade. The resistor is disposed between the cover plate and the blade in the sealed interior of the case. The resistor has a first side facing and abutting the cover plate, and a second side facing and abutting the blade so that the resistor is electrically connected between the cover plate and the blade. The resistor has a sufficient resistance so that when the second end of the blade moves from the first position to the second, open position a sufficient amount of heat is generated by current which now flows through the resistor to maintain the second end of the blade in the second position until a load current applied to the cover plate and the blade is removed. If desired, the fixed contact can be mounted on a conductive blade associated with the cover plate, such that the movable contact on the bimetal mates with this fixed contact in the circuit closed position.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DESCRIPTION OF THE PREFERRED EMBODIMENT

Figure 1:
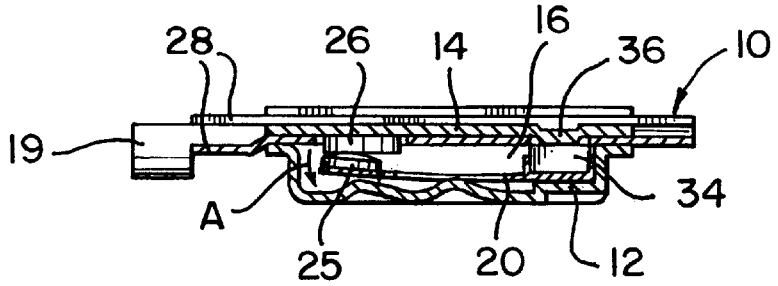
FIG. 1 is across-sectional view, taken along lines 1—1 of FIG. 3 and looking in the direction of the arrows, of the thermostat according to the present invention.
Figure 2:
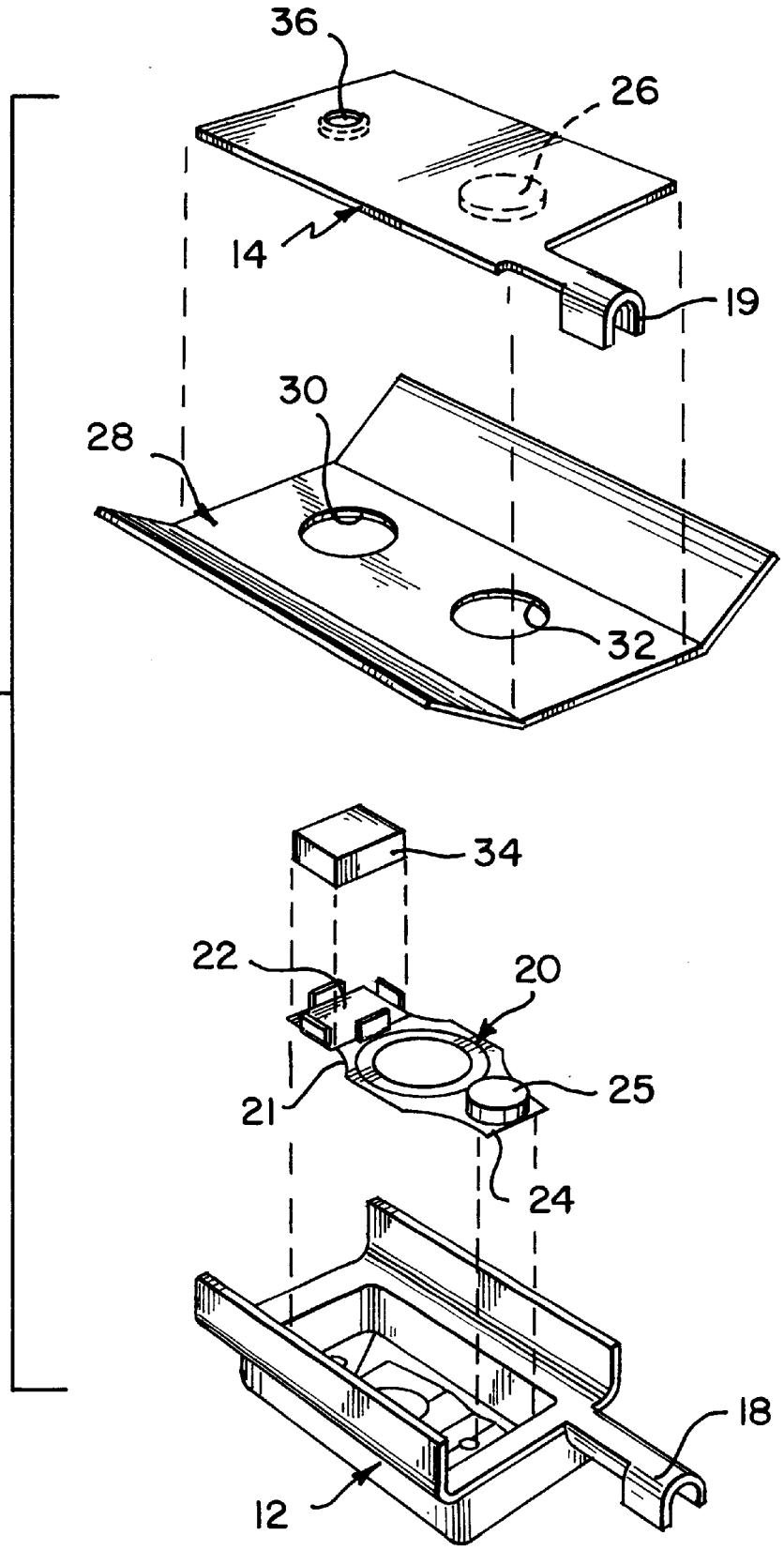
FIG. 2 is an exploded view of the thermostat according to the present invention.

Referring now to FIGS. 1 and 2, a cross-sectional view of a thermostat 10 according to a preferred embodiment of the invention is shown. Thermostat 10 includes an outer case 12 and a cover plate 14. Cover plate 14 is fixedly connected to case 12 to define a sealed enclosure 16, into which the remaining components are inserted. An insulator sheet 28 is disposed between cover plate 14 and case 12 to electrically isolate the cover plate from the case. Case 12 has a first terminal end 18 exterior to enclosure 16. Cover plate 14 has a second terminal end 19 exterior to enclosure 16. Case 12 and cover plate 14 are each made of a conductive material (preferably metal) so that the case and cover are electrically "live".

A thermostat blade 20 is inserted into case 12. Blade 20 has a first end 21 and a second contact end 24, both of which are disposed in the interior of case 12.

Figure 3:
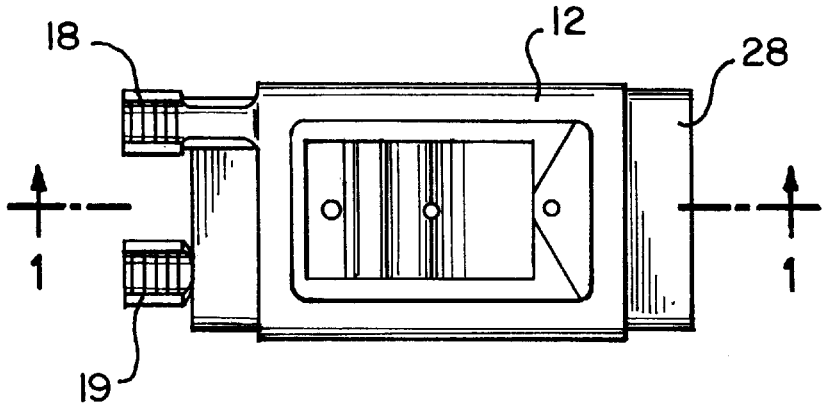
FIG. 3 is a bottom view of the thermostat according to the present invention.
Figure 4:
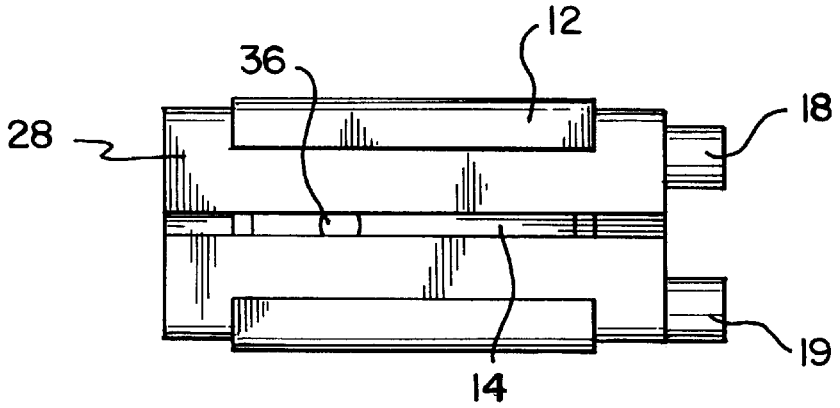
FIG. 4 is a top view of the thermostat according to the present invention.

Blade 20 moves with respect to case 12. The second end 24 of blade 20 moves between a first position and a second position. In the first position, a contact 25, disposed at the second end 24 of the blade 20, contacts an inwardly projecting contact 26 that is formed on cover plate 14 (or formed on a conductive blade attached to the cover plate), thereby completing the circuit between terminal end 18 and terminal end 19 (see FIG. 3). End 24 of blade 20 moves to a second position, in the direction indicated by arrow A in FIG. 1, so that contact 25 of blade 20 is spaced from the contact 26 of cover plate 14 upon the thermostat interior reaching a predetermined circuit opening or activation temperature.

The insulator sheet 28 is positioned between blade 20 and cover plate 14 so that blade 20 and, therefore, case 12 are electrically isolated from cover plate 14. Insulator sheet 28 has two throughbores 30, 32. First throughbore 30 is sized to receive a second inwardly directed projection 36 on cover plate 14, while second throughbore 32 is sized to receive contact 25 disposed at end 24 of blade 20.

The resistor 34 is mounted on a metal clip 22 mounted on the first end 21 of blade 20. Resistor 34 is electrically connected between cover plate 14 and blade 20. Resistor 34 is preferably made of about 90% by weight calcium borosilicate glass, with the balance being less than 10% by weight ruthenium dioxide powder and less than 1% by weight manganese dioxide. As illustrated in FIG. 2, resistor 34 preferably has a rectangular box shape. Resistor 34 may, however, have other shapes, such as, for example, a circular disc shape.

In operation, the two terminal contacts 18, 19 are connected to surrounding circuitry. For example, the thermostat can be mounted in a device, such as an overhead ventilator mounted over a stove, and can be used to disconnect the load current to the ventilator if the surrounding temperature exceeds a predetermined threshold temperature. In other words, as the ambient temperature surrounding the thermostat rises and reaches a predetermined activation temperature, bimetal blade 20 will bend away from fixed contact 26, so that contact 25 at end 24 of blade 20 is spaced from contact 26 of cover plate 14 to open the circuit between the two terminals 18, 19. Conventionally, once the ambient temperature decreased below a reset temperature, which is below the activation temperature, bimetal plate 20 would bend back toward cover plate 14 so that contact 25 contacts contact 26, thereby closing the circuit once again and permitting the ventilator to operate.

However, in accordance with the present invention, in the closed position the current being applied to the ventilator, and, thus, the two terminals 18, 19, travels between blade 20 and cover plate 14 via the electrical path created by contact 25 of blade 20 and contact 26 of cover plate 14. In this closed position, the current will follow the path of least resistance through the contacts 25, 26. Therefore, the current essentially does not flow through resistor 34 because of its relatively high resistance. However, in the open position, contacts 25 and 26 are spaced from each other. Thus, the current applied to the two terminals 18, 19 travels between blade 20 and cover plate 14 via the electrical path created by resistor 34. Resistor 34 is of a sufficient size and resistance that when the blade is moved to the open position, a sufficient amount of heat is generated by the resistor (e.g., 1 to 5 watts, preferably 1 to 3 watts) to maintain the temperature within case 12 at or above the reset temperature. Thus, the blade is maintained in the second open position until the load current being applied to the ventilator is removed, either by turning off the ventilator via a switch or removing the power line cord (i.e., unplugging the device). Thereafter, the thermostat will eventually cool down and reset itself when the ambient temperature falls below the reset level. The switch for the ventilator can then be turned back on or the power cord can be plugged back in to enable the ventilator to operate in the usual manner.

Having described the presently preferred exemplary embodiment of a sealed live case hold open thermostat in accordance with the present invention, it is believed that other modifications, variations and changes will be suggested to those skilled in the art in view of the teachings set forth herein. It is, therefore, to be understood that all such modifications, variations, and changes are believed to fall within the scope of the present invention as defined by the appended claims.

What is claimed is:

1. A thermostat comprising:

a case made of conductive material, said case having an exterior;

a cover plate made of a conductive material, said cover plate being connected to said case to define a sealed interior, said cover plate having a contact projecting into said sealed interior, said contact being fixed with respect to said case and having an interior contact position;

an insulator sheet disposed between said case and said cover plate;

a blade disposed in said sealed interior, said blade having a second end, said second end of said blade moving between a first position where said second end of said blade abuts said contact position of said contact and a second position where said second end of said blade is spaced from said interior contact position of said contact; and a resistor mounted on a first end of said blade, said resistor being disposed between said cover plate and said blade in said sealed interior of said case, said resistor having a first side facing and abutting said cover plate and a second side facing and abutting said blade so that said resistor is electrically connected between said cover plate and said blade, said resistor having a sufficient resistance so that when said second end of said blade moves from said first position to said second position a sufficient amount of heat is generated by current flowing through said resistor to maintain said second end of said blade in said second position until a load current applied to said cover plate and said blade is removed.

2. The thermostat as in claim 1, wherein said resistor is made of a ceramic material.

3. The thermostat as in claim 1, wherein said resistor has a rectangular box shape.

4. The thermostat as in claim 2, wherein said resistor has a rectangular box shape.

5. The thermostat as in claim 1, wherein said resistor generates from one to five watts when said second end of said blade is in said second position.

6. The thermostat as in claim 5, wherein said amount of heat generated by said resistor is between one and three watts.

7. The thermostat as in claim 1, wherein said contact is formed on said case.

8. The thermostat as in claim 1, wherein said insulator sheet has a first throughbore and a second throughbore.

9. The thermostat as in claim 8, wherein said cover plate has a second inwardly directed projection, and said first throughbore is sized to receive said second projection.

10. The thermostat as in claim 9, wherein said second throughbore is sized to receive a contact disposed on said first end of said blade.

11. The thermostat as in claim 1, wherein said resistor has a circular disc-shape.

12. The thermostat as in claim 2, wherein said resistor has a circular disc-shape.

* * * * *